US007481209B1

(12) United States Patent
Bligh et al.

(10) Patent No.: US 7,481,209 B1
(45) Date of Patent: Jan. 27, 2009

(54) TOY PROJECTILE LAUNCHER WITH SLIDABLE OUTER CYLINDER AND STATIONARY INNER COMPRESSION MEMBER

(75) Inventors: Amanda M. Bligh, Attleboro, MA (US); Raymond A. Mead, Providence, RI (US); Robert L. Brown, North Kingstown, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 11/852,760

(22) Filed: Sep. 10, 2007

Related U.S. Application Data

(62) Division of application No. 10/945,795, filed on Sep. 21, 2004, now Pat. No. 7,287,526.

(51) Int. Cl.
*F41B 11/00* (2006.01)

(52) U.S. Cl. ..... 124/63; 124/64; 124/65

(58) Field of Classification Search ..... 124/63, 124/67, 60, 56, 61, 64, 65, 66
See application file for complete search history.

(56) References Cited

U.S. PATENT DOCUMENTS

| | | | | |
|---|---|---|---|---|
| 3,763,587 | A * | 10/1973 | Firmalino | 42/106 |
| 4,289,109 | A * | 9/1981 | D'Andrade | 124/67 |
| 4,298,150 | A * | 11/1981 | Seldeen | 224/243 |
| 5,605,140 | A | 2/1997 | Griffin | 124/59 |
| 5,724,954 | A | 3/1998 | Smith | 124/66 |
| 5,791,326 | A | 8/1998 | Brown et al. | 124/66 |
| 5,901,693 | A | 5/1999 | Smith | 124/66 |
| 5,975,068 | A | 11/1999 | Halter et al. | 124/63 |
| 6,076,513 | A | 6/2000 | Doherty et al. | 124/66 |
| 6,250,294 | B1 | 6/2001 | Lim | 124/66 |
| 7,267,118 | B2 * | 9/2007 | Eddins et al. | 124/63 |
| 2003/0075037 | A1 * | 4/2003 | Hogmoe | 89/1.42 |
| 2003/0178455 | A1 * | 9/2003 | Rugh | 224/269 |

* cited by examiner

*Primary Examiner*—J. W Eldred
*Assistant Examiner*—Gabriel J Klein
(74) *Attorney, Agent, or Firm*—Marshall, Gerstein & Borun LLP

(57) ABSTRACT

The invention is directed to a toy projectile launcher for discharging a toy projectile attached thereto that may include a housing, a hollow outer cylinder, and a compression member that may be disposed on the housing, and slidably received within the hollow outer cylinder. The compression member may include a fluid passage therethrough in fluid communication with the interior of the outer cylinder. The interior of the outer cylinder may be moveable between an uncocked position and a cocked position such that movement of the outer cylinder from the cocked position toward the uncocked position compresses air in the interior of the outer cylinder, with the compressed air being delivered to through the fluid passage to a toy projectile attached to the toy projectile launcher. The toy projectile launcher may also include a spring that may bias the outer cylinder from the cocked position toward the uncocked position.

6 Claims, 16 Drawing Sheets

TOY PROJECTILE LAUNCHER WITH SLIDABLE OUTER CYLINDER AND STATIONARY INNER COMPRESSION MEMBER

REFERENCE TO RELATED APPLICATIONS

The present application is a divisional of U.S. Ser. No. 10/945,795, filed on Sep. 21, 2004, which is expressly incorporated by reference herein.

BACKGROUND OF THE INVENTION

The present invention relates generally to a toy projectile launcher and, more particularly, to a projectile launcher having a slidable outer cylinder and a stationary inner compression member.

Toy projectile launchers that eject toy projectiles with a burst of pressurized air are generally known in the art. For example, U.S. Pat. No. 5,724,954 to Smith discloses a projectile launcher having a housing, a projectile launch tube slidably joined to the housing for movement between a first position and a second position, a launch tube spring biasing the launch tube towards the first position and a piston slidably disposed in the housing for movement from an un-cocked position to a cocked position in response to the launch tube moving from the first position to the second position. The launch tube includes a first portion for releasably mounting a projectile and a hollow second portion in fluid communication with the first portion, with the piston moving from the cocked position to the un-cocked position to compress fluid in the second portion of the launch tube. The projectile launcher further includes a piston spring biasing the piston toward the un-cocked position, a sear slidably joined to the housing for releasably retaining the piston in the cocked position, and a release means for sliding the sear to release the piston from the cocked position.

U.S. Pat. No. 5,791,326 to Brown et al., discloses a toy projectile launcher having a housing, a cylinder fixed to the housing and defining an inner bore, a projectile launch tube slidably disposed in the cylinder for movement from a cocked position to an un-cocked position to compress gas in the cylinder, and a projectile holder in fluid communication with the cylinder to releasably mount a projectile to be launched. The toy projectile launcher further includes a seal fixed to the projectile launch tube and in sealing engagement with the cylinder inner bore, a sear for releasably engaging the projectile launch tube in the cocked position, biasing means for returning the projectile launch tube to the un-cocked position, and a trigger for engaging the sear to release the projectile launch tube from the cocked position and emit compressed gas to the projectile holder.

SUMMARY OF THE INVENTION

In one aspect, the invention is directed to a toy projectile launcher for discharging a toy projectile attached thereto that may include a housing, a hollow outer cylinder, and a compression member that may be disposed on the housing, and slidably received within the hollow outer cylinder. The compression member may include a fluid passage therethrough in fluid communication with the interior of the outer cylinder. The interior of the outer cylinder may be moveable between an uncocked position and a cocked position such that movement of the outer cylinder from the cocked position toward the uncocked position compresses air in the interior of the outer cylinder, with the compressed air being delivered to through the fluid passage to a toy projectile attached to the toy projectile launcher. The toy projectile launcher may also include a spring that may bias the outer cylinder from the cocked position toward the uncocked position.

In another aspect, the invention is directed to a toy projectile launcher for discharging a toy projectile attached thereto that may include a housing, a hollow outer cylinder, and a compression member that may be disposed on the housing, and slidably received within the hollow outer cylinder. The compression member may include a fluid passage therethrough in fluid communication with the interior of the outer cylinder. The interior of the outer cylinder may be moveable between an uncocked position and a cocked position such that movement of the outer cylinder from the cocked position toward the uncocked position compresses air in the interior of the outer cylinder, with the compressed air being delivered to through the fluid passage to a toy projectile attached to the toy projectile launcher.

The toy projectile launcher may also include a spring that may bias the outer cylinder from the cocked position toward the uncocked position, and a lock member that may be disposed on the housing and movable between a locked position wherein the lock member engages the outer cylinder to retain the outer cylinder in the cocked position when the outer cylinder is disposed in the cocked position, and an unlocked position wherein the lock member is disengaged from the outer cylinder when the outer cylinder is in the cocked position to allow the outer cylinder to move between the cocked position and the uncocked position. Still further, the toy projectile launcher may include a first trigger that may be operatively connected to the lock member and moveable between a normal position and a firing position, wherein movement of the first trigger from the normal position to the firing position may cause the lock member to move from the locked position to the unlocked position.

In a further aspect, the invention is directed to a toy projectile launcher for discharging a toy projectile attached thereto that may include a housing, a hollow outer cylinder, and a compression member that may be disposed on the housing, and slidably received within the hollow outer cylinder. The compression member may include a fluid passage therethrough in fluid communication with the interior of the outer cylinder. The interior of the outer cylinder may be moveable between an uncocked position and a cocked position such that movement of the outer cylinder from the cocked position toward the uncocked position compresses air in the interior of the outer cylinder, with the compressed air being delivered to through the fluid passage to a toy projectile attached to the toy projectile launcher. The toy projectile launcher may also include a spring that may bias the outer cylinder from the cocked position toward the uncocked position.

The toy projectile launcher may further include a slide member slidably that may be disposed on the housing and operatively connected to the outer cylinder such that movement of the slide member from a first position to a second position causes the inner cylinder to move from the uncocked position to the cocked position, and a lock member that may be disposed on the housing and movable between a locked position wherein the lock member may engage the outer cylinder to retain the outer cylinder in the cocked position when the outer cylinder may be disposed in the cocked position, and an unlocked position wherein the lock member may be disengaged from the outer cylinder when the outer cylinder is in the cocked position to allow the outer cylinder to move between the cocked position and the uncocked position. Still further, the toy projectile launcher may include a first trigger and a second trigger. The first trigger may be operatively connected to the lock member and moveable between a normal position and a firing position, wherein movement of the first trigger from the normal position to the firing position may cause the lock member to move from the locked position to the unlocked position. The second trigger may be operatively connected to the lock member and moveable between a normal position and a firing position, wherein movement of the second trigger from the normal position to the firing position may cause the lock member to move from the locked position to the unlocked position.

In a still further aspect, the invention is directed to a toy projectile launcher for discharging a toy projectile. The toy projectile launcher may include a housing, an air compression mechanism on the housing, and a slide member slidably disposed on the housing and operatively connected to the air compression mechanism such that movement of the slide member from a first position to a second position causes the air compression mechanism to move from the uncocked position to the cocked position. The toy projectile launcher may further include a retention member configured to demountably attach to the slide member, wherein the slide member may move from the first position to the second position when the retention member is demountably attached thereto, and an attachment mechanism connected to the retention member and configured to engage an article of clothing of a user of the toy projectile launcher.

DETAILED DESCRIPTION OF VARIOUS EMBODIMENTS

Although the following text sets forth a detailed description of an exemplary embodiment of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
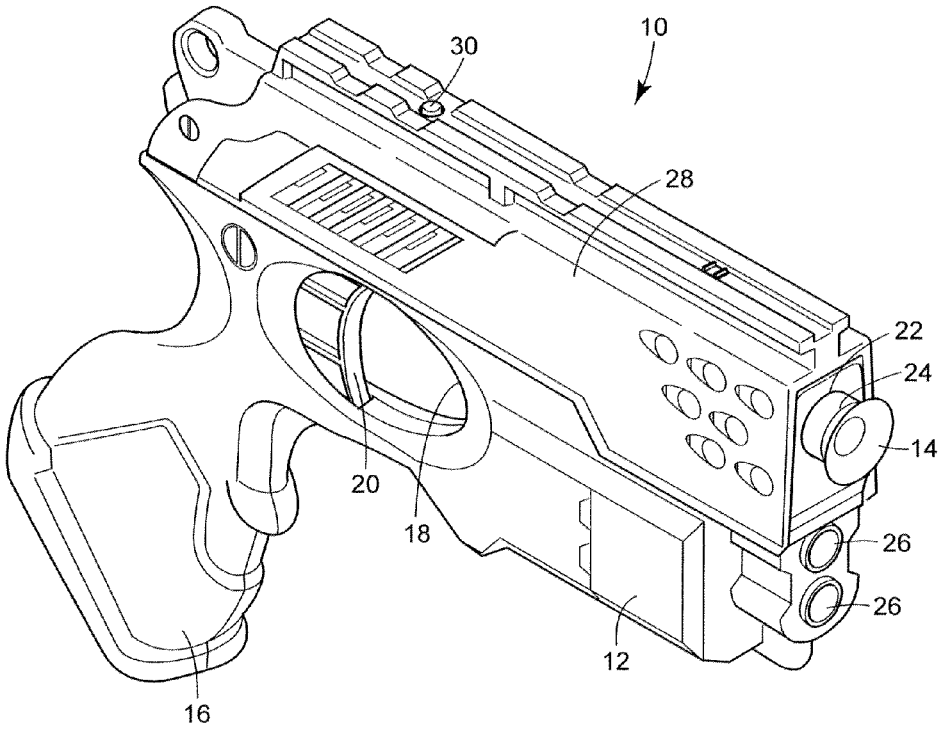
FIG. 1 is a top right perspective view of an embodiment of a toy projectile launcher.

FIG. 1 illustrates one embodiment of a toy projectile launcher 10 in accordance with the present invention. The toy projectile launcher 10 may include an outer hollow housing 12 and an interior firing mechanism (not shown) configured to generate a burst of pressurized air to project a projectile, such as a dart 14, outwardly from the toy projectile launcher 10. In the illustrated embodiment, the housing 12 may be configured in the shape of a pistol including a grip 16 and finger guard opening 18 that may be grasped by a user in a manner allowing the user to pull a trigger 20 to fire the toy projectile launcher 10. The trigger 20 may be configured to actuate the interior mechanism of the toy projectile launcher 10 when the trigger 20 is squeezed by the user in a manner described more fully hereinafter.

The housing 12 may further include an opening 22 through which a muzzle 24 may extend from the interior of the toy projectile launcher 10, with the muzzle 24 being adapted to receive the dart 24 or other appropriate projectile in preparation for firing the toy projectile launcher 10. The housing 12 may further define one or more reserve slots 26 configured to receive extra darts 14 or other projectiles for storage prior to loading the projectile into the muzzle 24. The toy projectile launcher 10 may further include a slide member 28 slidably disposed on the exterior of the housing 12. The slide member 28 may be operatively connected to the interior firing mechanism of the toy projectile launcher 10 such that when the slide member 28 is drawn rearward on the housing 12 by the user, the slide member 28 may cause the interior firing mechanism to move to a cocked position in preparation for discharging the dart 14 from the muzzle 24. Still further, the toy projectile launcher 10 may include a secondary trigger 30 disposed within and extending upwardly from the slide member 28, and moveable from a normal position to a firing position wherein the secondary trigger 30 may engage the interior firing mechanism of the toy projectile launcher 10 to actuate the interior firing mechanism in a manner described more fully below.

Figure 2:
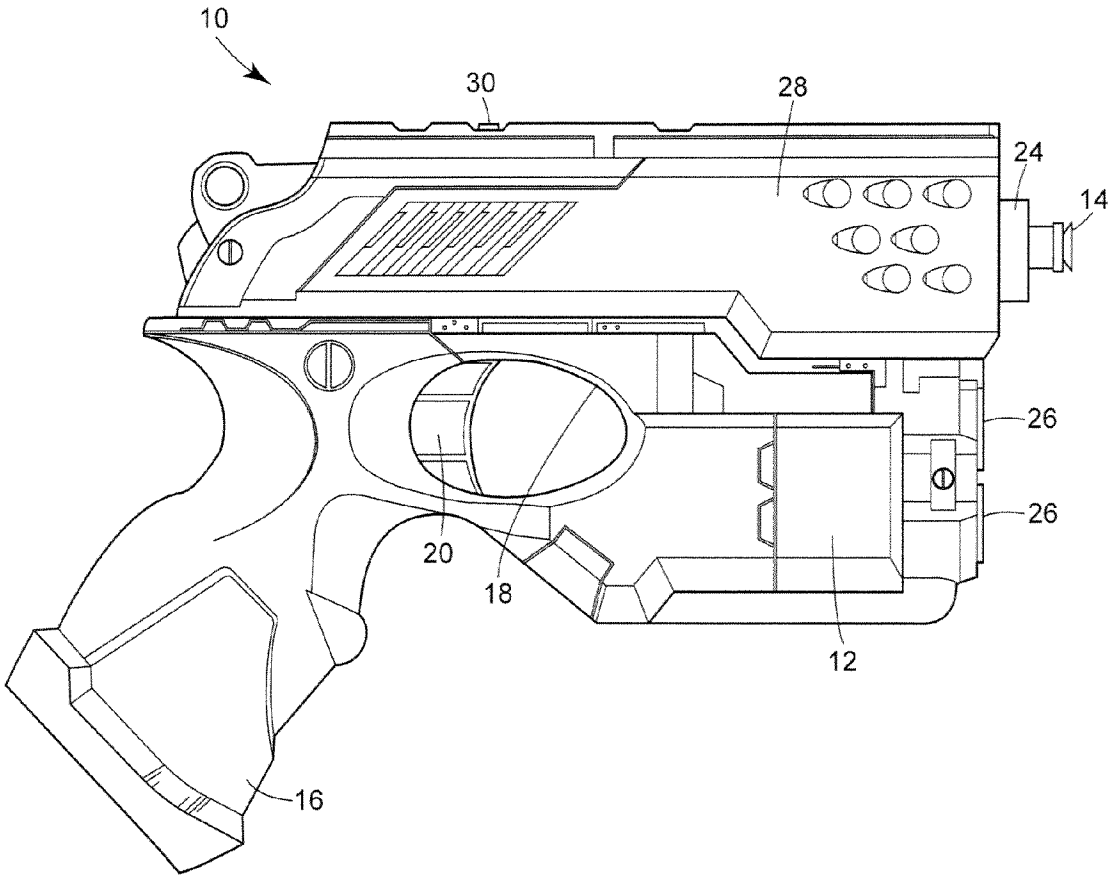
FIG. 2 is a side view of the toy projectile launcher of FIG. 1.
Figure 3:
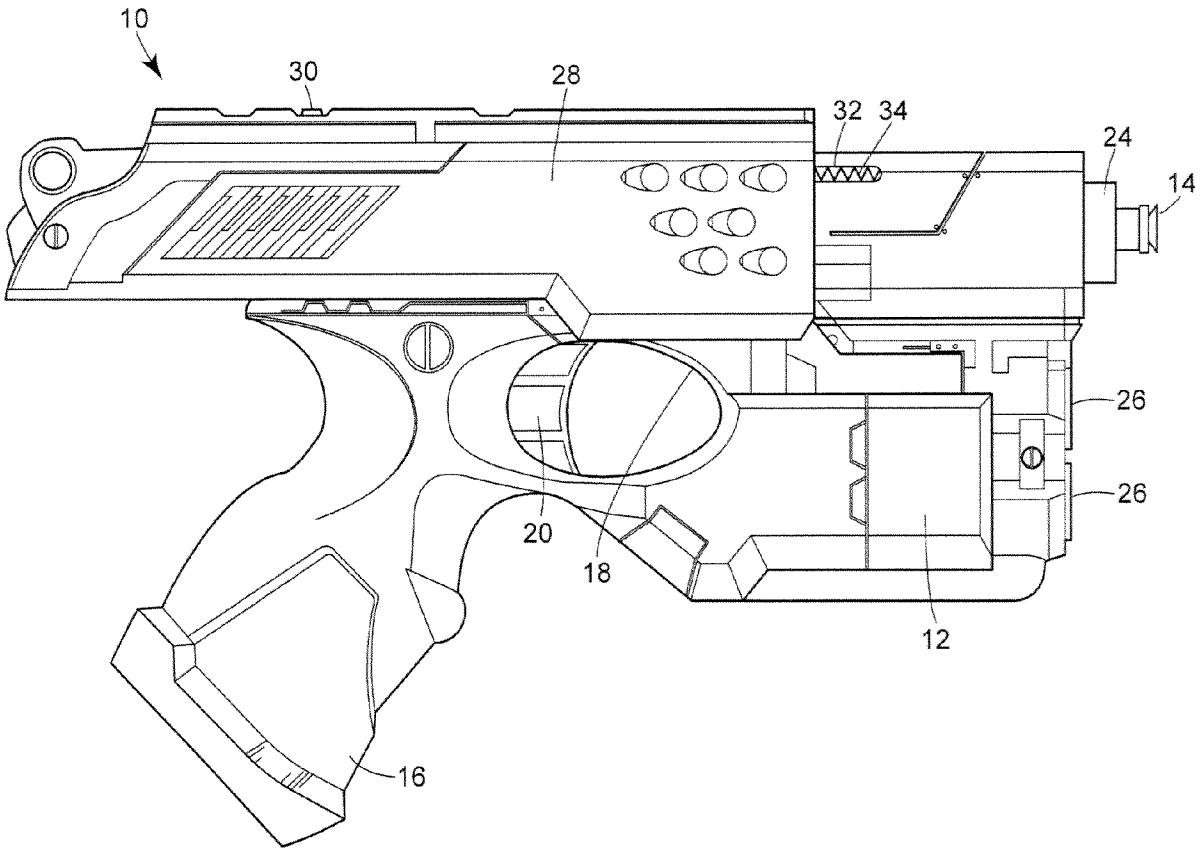
FIG. 3 is a side view of the toy projectile launcher of FIG. 1 with the slide member in the cocking position.

FIGS. 2 and 3 illustrate the cocking of the toy projectile launcher 10. Referring to FIG. 2, the toy projectile launcher 10 is illustrated with the slide member 28 disposed in the normal forward position on the housing 12 with the dart 14 disposed in the muzzle 24. In FIG. 3, the slide member 28 is illustrated as drawn rearward on the housing 12 to the cocking position. Access to the interior of the housing 12 and, consequently, the interior firing mechanism of the toy projectile launcher 10, may be provided via a slot 32 through the walls of the housing 12. A spring 34 may be disposed on the interior of the housing 12, and may be connected at one end to the interior of the housing 12, and at the opposite end to the slide member 28 such that the spring 34 applies a force to the slide member 28 biasing the slide member 28 to its forward position on the housing 12. After the slide member 28 is drawn rearward to the cocking position such that the interior mechanism of the toy projectile launcher 10 is cocked and ready for firing, the slide member 28 may return to the normal forward position of FIG. 2 under the urging of the spring 34.

Figure 4:
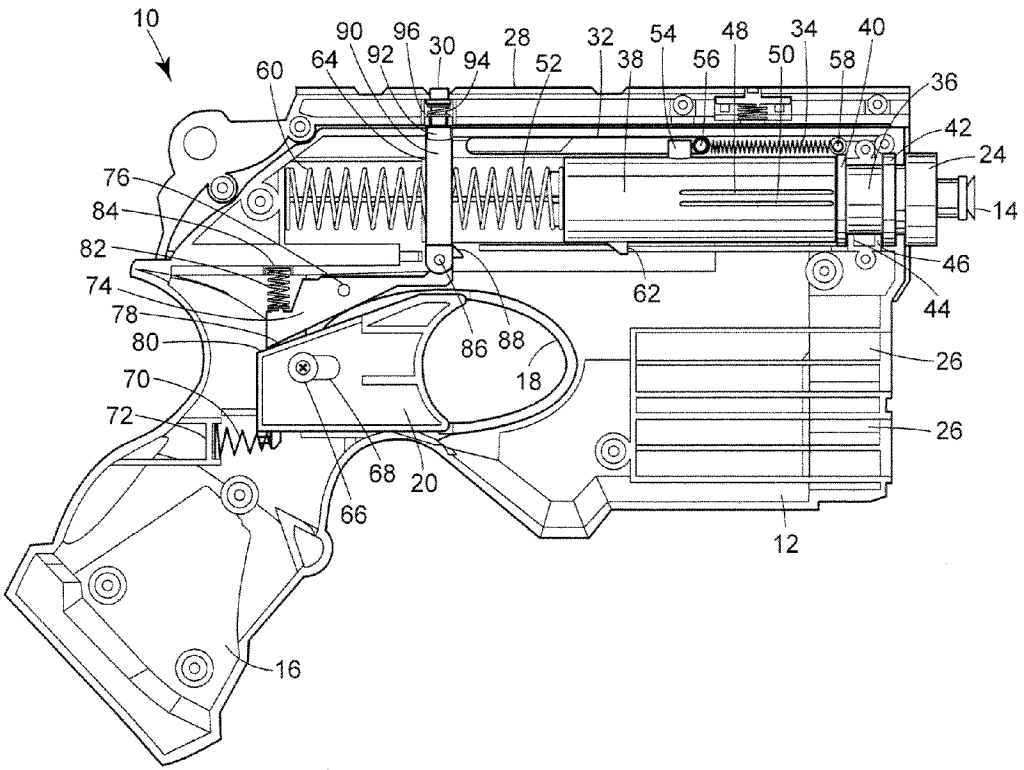
FIG. 4 is a side view of the toy projectile launcher of FIG. 1 with the right half of the housing removed and the toy projectile launcher in an un-cocked position.

FIG. 4 illustrates the interior of the toy projectile launcher 10 with the right half of the housing 12 removed. The interior firing mechanism of the toy projectile launcher 10 may include a stationary inner cylinder 36 and a slidable outer cylinder 38. The inner cylinder 36 may be hollow such that the dart 14 may be received in the muzzle 24, and may include one or more flanges 40, 42 extending outwardly from the outer wall of the inner cylinder 36. When the inner cylinder 36 is disposed within the housing 12, the flanges 40, 42 may be engaged by corresponding support walls 44, 46 such that the inner cylinder 36 remains substantially stationary within the housing 12 as the toy projectile launcher 10 is cocked and fired.

The outer cylinder 38 may be hollow and slidably disposed about the stationary inner cylinder 36. The outer cylinder 38 may include pairs of horizontal ribs 48, 50 extending outwardly on opposite sides of the outer surface of the outer cylinder 38. Each pair of ribs 48, 50 may define a substantially horizontal channel configured to receive a corresponding horizontal rib 52 extending inwardly from an inner surface of the housing 12. When the outer cylinder 38 is disposed within the housing 12 with the ribs 52 of the housing disposed within the corresponding pairs of ribs 48, 50 of the outer cylinder 38, the outer cylinder 38 may slide horizontally forward and rearward with the ribs 48, 50, 52 preventing the outer cylinder 38 from rotating about its longitudinal axis.

The outer cylinder 38 may further include an upwardly extending shoulder 54 disposed proximate the slot 32 in the housing 12 when the outer cylinder 38 is disposed within the housing 12. A rod 56 connected to the slide member 28 may pass through the slot 32 proximate the shoulder 54. The biasing spring 34 for the slide member 28 may have one end connected to the rod 56 and the opposite end connected to a support post 58 extending inwardly from the inner surface of the housing 12. Connected in this manner, the force of spring 34 acting on the rod 56 and, consequently, the slide member 28, biases the slide member 28 toward its normal forward position. When the slide member 28 is drawn rearward to cock the toy projectile launcher 10, the rod 56 may engage the shoulder 54 of the outer cylinder 38 to push the outer cylinder 38 rearward against the biasing force of a spring 60 toward the cocked position. While the spring 60 is illustrated herein as being dispose behind the outer cylinder 38, those skilled in the art will understand that the spring 60 may be configured in any manner such that the outer cylinder 38 is biased toward the normal position by the spring 60. Consequently, in one embodiment, the spring 60 may encircle the outer cylinder 38 and engage a forward flange extending outwardly from the outer surface of the outer cylinder 38 to bias the outer cylinder 38 forward. Still further, the spring 60 may be disposed adjacent the outer cylinder 38 while engaging the outer cylinder 38 and biasing the outer cylinder 38 to the normal position. Other configurations of a spring 60 engaging outer cylinder 38 will be apparent to those skilled in the art and are contemplated as having use with the toy projectile launcher of the present invention. The outer cylinder 38 may further include a downwardly extending finger 62 adapted to be engaged by a lock member 64 when the outer cylinder 38 is in the cocked position in a manner that will be described more fully below.

As previously discussed, a portion of the trigger 20 extends through the housing within a finger guard opening 18. The trigger 20 may be secured to the interior of the housing 12 by a flat-head screw 66 disposed through a slot 68 of the trigger 20, with the screw 66 being screwed into a corresponding portion of the housing 12. The head of the screw 66 secures the trigger 20 to the left half of the housing 12, but is loose enough such that the trigger 20 may move rearward and forward as the screw 66 slides within the slot 68. A spring 70 may be disposed between the trigger 20 and a support wall 72 such that the spring 70 biases the trigger 20 toward its normal forward position.

The firing mechanism of the toy projectile launcher 10 may further include a rocker arm 74 pivotally connected to the housing 12 by a pivot pin 76. The rocker arm 74 may include a finger 78 disposed proximate a camming surface 80 of the trigger 20, and may be biased to rotate in a counter-clockwise direction with the finger 78 engaging the camming surface 80 of the trigger 20 by a spring 82 disposed between the finger 78 of the rocker arm 74 and a support wall 84 of the housing 12. The rocker arm 74 may further be pivotally connected to a lower end of the lock member 64 by a connecting pivot pin 86. The lock member 64 may include a camming surface adapted to engage the finger 62 of the outer cylinder 38 in a manner described more fully below during the process of cocking the toy projectile launcher 10. The locking member 64 may further include a hollow body through which the spring 60 and outer cylinder 38 may pass during the operation of the toy projectile launcher 10. A knob 92 may extend upwardly from the hollow body 90 and be disposed proximate a lower end of the secondary trigger 30 when the slide member 28 is in the normal position. A spring 94 disposed between the head of the secondary trigger 30 and a support wall 96 of the slide member 28 may bias the secondary trigger 30 upwardly away from the knob 92.

Figure 5:
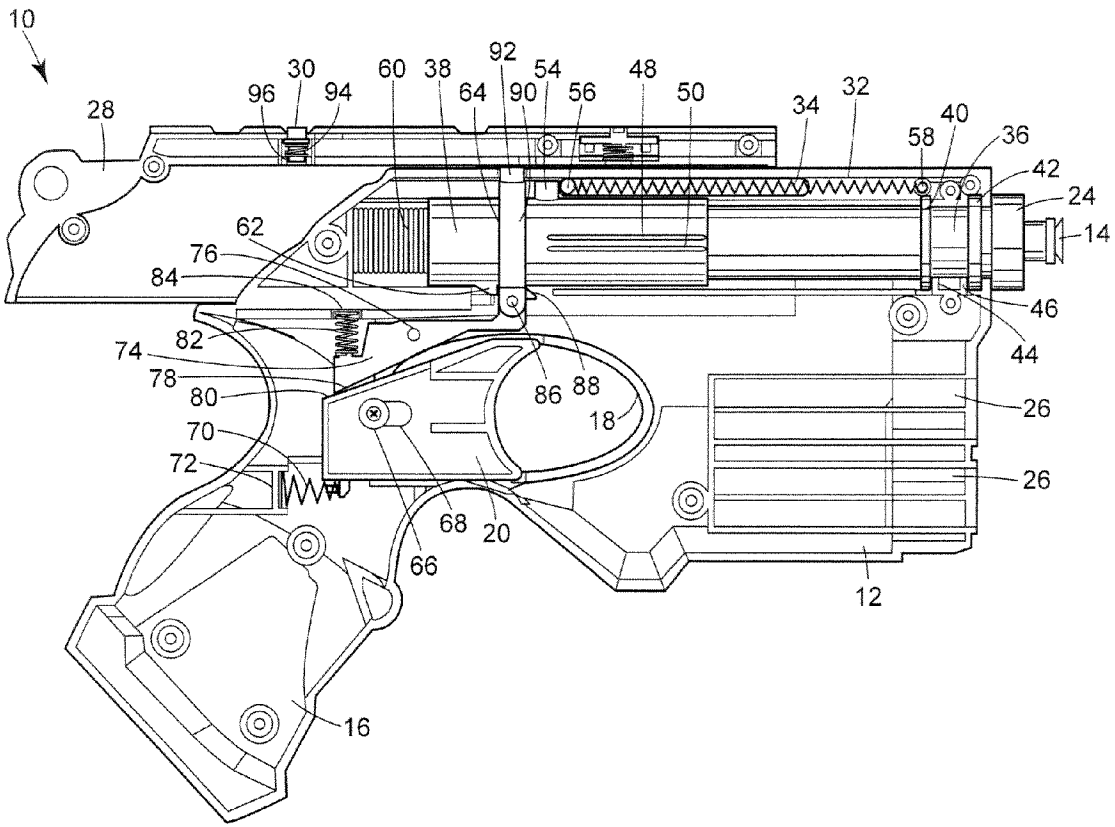
FIG. 5 is a side view of the toy projectile launcher of FIG. 1 with the right half of the housing removed and with the slide member in the cocking position.

The cocking of the toy projectile launcher 10 will now be described with reference to FIG. 5. As the slide member 28 is drawn rearward by the user of the toy projectile launcher 10, the rod 56 engages the shoulder 54 of the outer cylinder 38 to slide the outer cylinder 38 rearward along with the slide member 28. As the outer cylinder 38 moves rearward, the ribs 48, 50, 52 cause the outer cylinder 38 to slide rearwardly without rotation about the longitudinal axis of the outer cylinder 38. As the outer cylinder 38 moves rearward, the finger 62 approaches the lock member 64 and is engaged by the camming surface 88 of the lock member 64. As the slide member 28 and outer cylinder 38 continue to move rearwardly, the engagement of the camming surface 88 by the finger 62 causes the lock member 64 to move downwardly so that the finger 62 may pass through the hollow body 90. As the lock member 64 moves downwardly, the rocker arm 74 rotates clockwise about the pivot pin 76 against the urging of the spring 82. Once the finger 62 moves rearward past the camming surface 88 and hollow body 90, the force of the spring 82 causes the rocker arm 74 to rotate counter-clockwise, with the lock member 64 correspondingly moving upward until the lower surface of the hollow body 90 engages the surface of the outer cylinder 38 and the flat vertical surface of the finger 62 being engaged by the lock member 64 to lock the outer cylinder 38 in the cocked position against the urging of the spring 60. When the slide member 28 is released, the slide member 28 moves forwardly under the urging of spring 34 to its normal forward position while the outer cylinder 38 is retained in the cocked position by the lock member 64.

Figure 6:
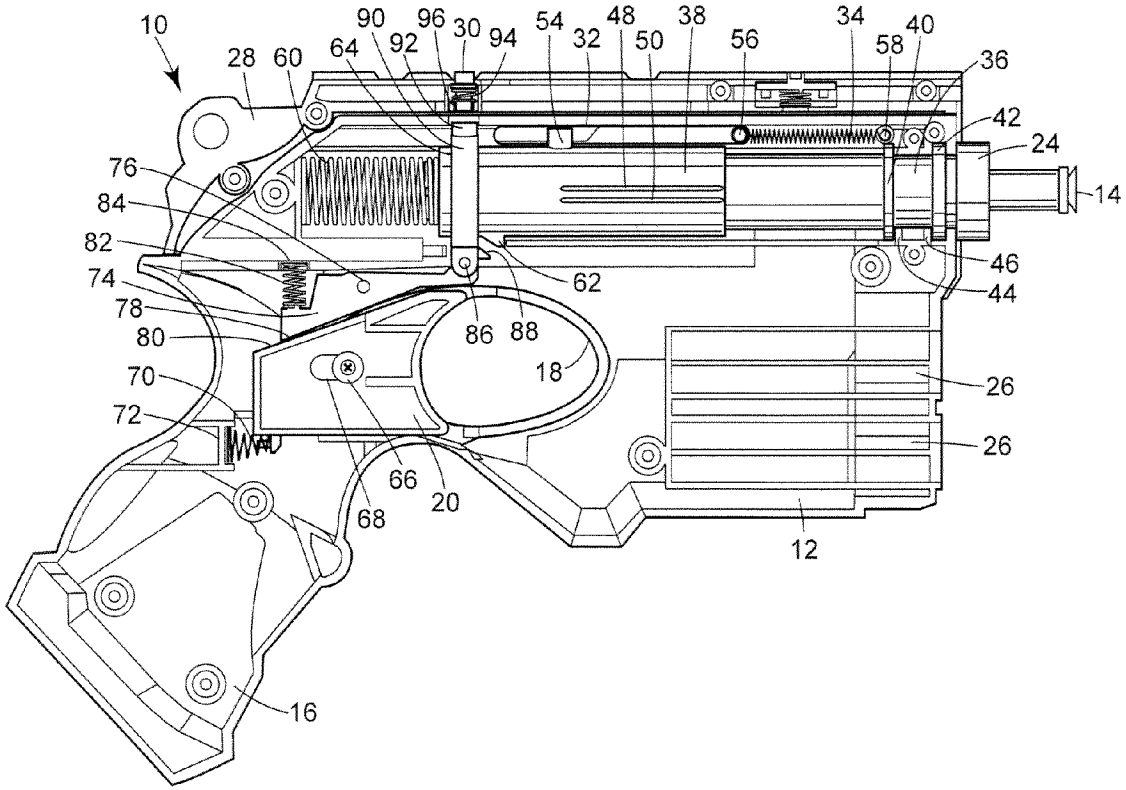
FIG. 6 is a side view of the toy projectile launcher of FIG. 1 with the right half of the housing removed and with the trigger in the firing position.

Referring now to FIG. 6, the toy projectile launcher 10 is illustrated at the onset of firing the dart 14 from the toy projectile launcher 10, with the outer cylinder 38 released from the lock member 64 and beginning to move forward under the urging of the spring 60. As the user of the toy projectile launcher 10 pulls the trigger 20, the trigger 20 moves rearwardly in the housing 12 against the urging of the spring 70 in a substantially linear path as the slot 68 slides over the screw 66. As the trigger 20 moves rearward, the camming surface 80 of the trigger 20 engages the finger 78 of the rocker arm 74 to rotate the rocker arm 74 clockwise about the pivot pin 76 against the urging of the spring 82. As the rocker arm 74 rotates clockwise, the rocker arm 74 and connecting pin 86 cause a corresponding downward movement of the lock member 64 within the housing 12. As the lock member 64 moves downward, the lower surface of the hollow body 90 moves below the finger 62, thereby releasing the outer cylinder 38. Once the finger 62 is disengaged from the hollow body 90, the outer cylinder 38 is thrust forward by the spring 60 to compress the air in the outer cylinder 38 and cause a burst of pressurized air to expel the dart 14 from the muzzle 24. After the toy projectile launcher 10 is fired and the trigger 20 is released, the trigger 20 slides forward to its normal position under the urging of the spring 70. At the same time, the contour of the camming surface 80 permits the rocker arm 74 to rotate counter-clockwise under the urging of the spring 82 and, correspondingly, move the locking member 64 upwardly to the normal position.

As an alternative firing mechanism, the secondary trigger 30 may be pushed downwardly against the force of the spring 94 into engagement with the knob 92 of the locking member 64. The downward movement of the secondary trigger 30 causes a corresponding downward movement of the locking member 64 to move the hollow body 90 out of engagement with the finger 62 of the outer cylinder 38 until the outer cylinder 38 may be thrust forward by the spring 60. The downward movement of the locking member 64 causes a corresponding clockwise rotation of the rocker arm 74 against the force of the spring 82. When the secondary trigger 30 is released, the rocker arm 74 rotates counter-clockwise under the force of the spring 82, thereby returning the lock member 64 to its normal position.

Figure 7:
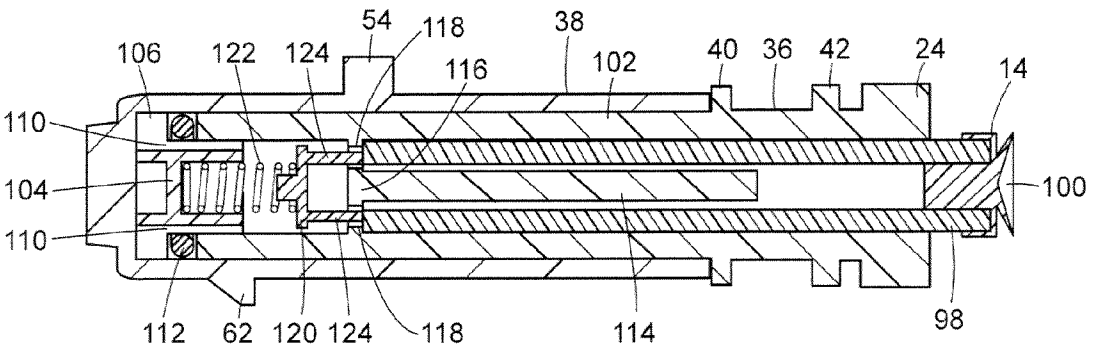
FIG. 7 is a side cross-sectional view of the firing mechanism of the toy projectile launcher of FIG. 1 in the un-cocked position.
Figure 7A:
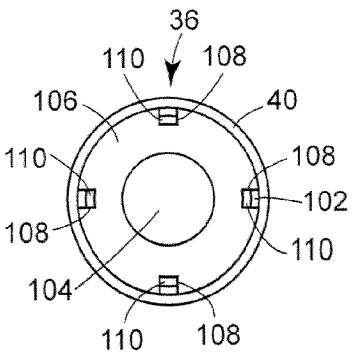
FIG. 7*a* is an end view of an inner cylinder of the toy projectile launcher of FIG. 1.
Figure 8:
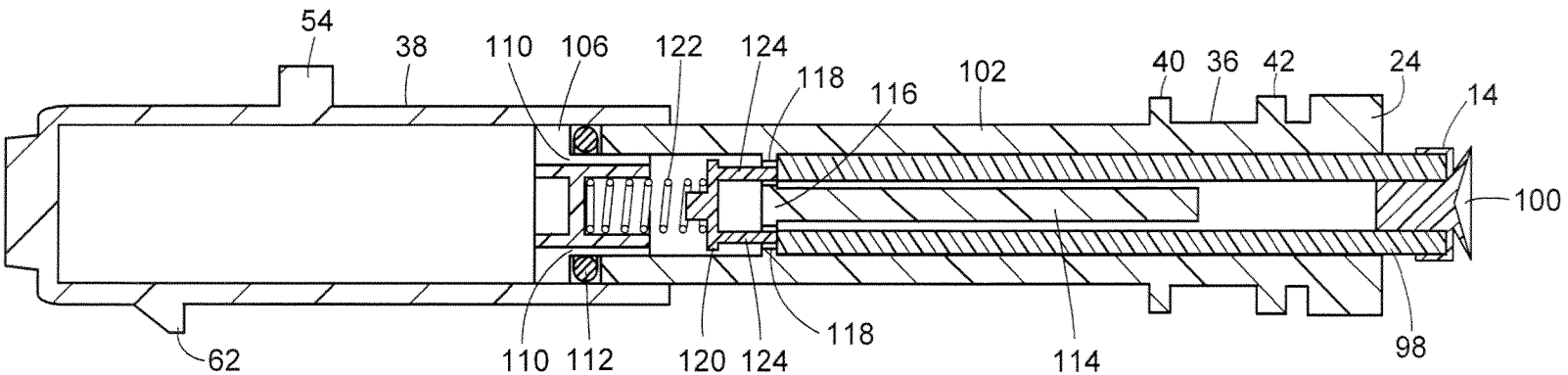
FIG. 8 is a side cross-sectional view of the firing mechanism of the toy projectile launcher of FIG. 1 in the cocked position.
Figure 9:
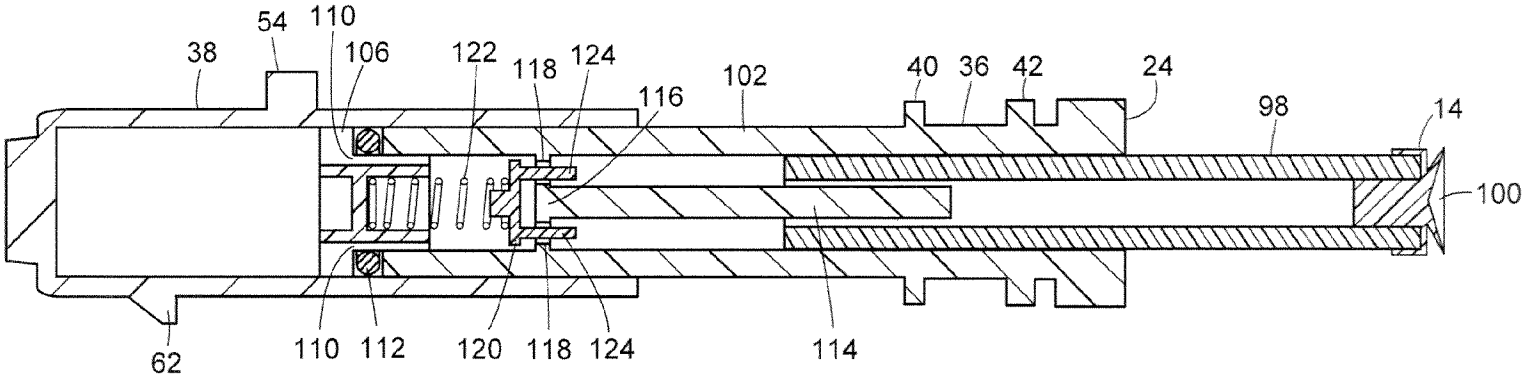
FIG. 9 is a side cross-sectional view of the firing mechanism of the toy projectile launcher of FIG. 1 in an intermediate firing position.

FIGS. 7 through 9 illustrate the interior of the firing mechanism provided by inner cylinder 36 and outer cylinder 38 in greater detail. Referring to FIG. 7, which shows inner cylinder 36 and outer cylinder 38 in their normal positions, the inner cylinder 36 is slidably disposed within outer cylinder 38 with the outer surface of the inner cylinder 36 in close proximity to the inner surface of the outer cylinder 38. The dart 14 is slidably disposed within the inner cylinder 36 with an outer surface of a body 98 in close proximity to the inner surface of the inner cylinder 36, and with a tip 100 of the dart 14 being disposed external to the muzzle 24. The inner cylinder 36 may include a generally hollow tube 102 having an end cap 104 disposed within the end opposite the muzzle 24. The end cap 104 may include a body portion disposed within the hollow tube 102, and have an outwardly extending flange 106 disposed external to the hollow tube 102. As best seen in FIG. 7A, which is an end view of the inner cylinder 36, the flange 106 may extend outwardly and have approximately the same outer diameter as the outer diameter of the hollow tube 102. The flange 106 may further include a plurality of notches 108 spaced about the circumference of the flange 106 and being cut inwardly such that channels 110 are formed inward of the inner surface of the hollow tube 102. The notches 108 and corresponding channels 110 may continue through the corresponding portions of the outer surface of the body of the end cap 104 such that the channels 110 place the exterior of the inner cylinder 36 proximate the end cap 104 in fluid communication with the interior of the inner cylinder 36 such that air may pass from the exterior of the inner cylinder 36 through the channels 110 and into the interior of the inner cylinder 36. Returning to FIG. 7, the firing mechanism may further include an O-ring gasket 112 disposed about the body of the end cap 104 between the flange 106 and the hollow tube 102. The O-ring gasket 112 may engage the walls of the inner cylinder 36 and the outer cylinder 38 to form a substantially airtight seal therebetween such that compressed air will flow through the channels 110 to the interior of the hollow tube 102 instead of between the outer surface of the hollow tube 102 and the inner surface of the outer cylinder 38 when the outer cylinder 38 moves forward to compress the air residing therein and discharge the dart 14.

In order to insure that the toy projectile launcher 10 may only discharge projectiles for which the toy projectile launcher 10 is designed to discharge, such as the dart 14, the firing mechanism may include additional safety features to prevent the discharge of foreign, and potentially dangerous, objects. For example, the hollow tube 102 of the inner cylinder 36 may include a central post 114 extending from a support wall 116 within the interior of the hollow tube 102. The post 114 may be dimensioned such that a substantially tubular projectile, such as the dart 14 having the hollow cylindrical body 98, may be inserted into the inner cylinder 36 through the muzzle 24. Other elongated objects, such as pens, pencils, and the like may be prevented from being inserted into the inner cylinder 36 due to their engagement with the central post 114.

In order to allow air flow through the hollow tube past the support wall 116, the support wall 116 may include one or more slots 118 therethrough providing passageways for air flowing between the end cap 104 and the muzzle 24 of the inner cylinder 36. In addition to the central post 114, the inner cylinder 136 may further include a safety valve 120 disposed between the end cap 104 and the support wall 116 that may function to prevent the discharge of compressed air from the toy projectile launcher 10 when the dart 14 is not disposed within the inner cylinder 36. The safety valve 120 may be biased toward the support wall 116 by a spring 124 disposed between the end cap 104 and a rear surface of the safety valve 120. Safety valve 120 may further include one or more fingers 124 corresponding to the slots 118 of the support wall 116 and extending therethrough to engage the rear surface of the body 98 of the dart 14 when the dart 14 is inserted in inner cylinder 36. In the absence of the dart 14, or if the dart 14 is only partially inserted into the inner cylinder 36, the fingers 124 may pass through the slots 118 with the safety valve 120 engaging the support wall 116 and covering the slots 118 such that air compressed by the forward movement of the outer cylinder 38 may not flow through the slots 118 and discharge from the muzzle 24 of the toy projectile launcher 10. Configured in this way, the safety valve 120 may prevent the discharge of smaller objects disposed in the muzzle 24 of the inner cylinder 36 forward of the center post 114, such as dirt, mud, rocks, marbles and the like. When the dart 14 is properly inserted in the inner cylinder 36 as shown in FIG. 7, the rearward edge of the body 98 of the dart 14 engages the fingers 124 to push the safety valve 120 rearwardly towards the end cap 104 against the force of the spring 122. With the safety valve in the open position as shown, air compressed by the forward movement of the outer cylinder 38 may flow through the slots 118 to discharge the dart 14.

Referring to FIG. 8, the firing mechanism of the toy projectile launcher 10 is illustrated with the outer cylinder 38 in the cocked position. As the outer cylinder 38 is drawn rearward to the cocked position, air may be permitted to flow between the body 98 of the dart 14 and the inner wall of the hollow tube 102, through the slots 118 and the support wall 116, through the channels 110 of the end cap 104, and into the space within the outer cylinder 38. The safety valve 120 may he configured to either allow or prevent the cocking of the outer cylinder 38 when the dart 14 is not disposed within the hollow tube 102. If it is desired to allow the outer cylinder 38 to be cocked without the dart 14, the spring 122 may be configured such that the force exerted on the safety valve 120 is insufficient to withstand the pressure differential created between the ambient atmosphere and the interior of the outer cylinder 38 as the rearward movement of the outer cylinder 38 creates an expansion of the volume within the outer cylinder 38. As the outer cylinder 38 is drawn rearward, the pressure differential may cause the safety valve 120 to move rearwardly against the force of the spring 122 thereby opening the slots 118 to allow air to flow rearward and into the outer cylinder 38. Conversely, if desired, the spring 122 may be configured to provide sufficient force to prevent the safety valve 120 from moving rearward as the outer cylinder 38 is drawn rearward toward the cocked position.

FIG. 9 illustrates the firing mechanism of the toy projectile launcher 10 at the initiation of firing with the outer cylinder 38 thrusting forward under the force of the spring 60. As the outer cylinder 38 moves forward, compressed air may flow through channels 110 and slots 118 and up against the body 98 of the dart 14 to project the dart 14 outwardly from the toy projectile launcher 10. The dart 14 is illustrated herein in an intermediate discharge position. As the rearward surface of the body 98 of the dart 14 moves away from the support wall 116 and disengages from the fingers 124, the safety valve 120 may begin to move forward toward the support wall 116 under the biasing force of the spring 122. Ultimately, after sufficient compressed air from the outer cylinder 38 discharges the dart 14 from the inner cylinder 36, the safety valve 120 may engage the support wall 116 and cover the slots 118 so that the toy projectile launcher 10 may not be discharged again unless another dart 14 is properly inserted into the inner cylinder 36.

While particular examples of the toy projectile launcher 10 are illustrated and described herein, those skilled in the art will understand that other configurations of toy projectile launchers may be implemented wherein the firing mechanism incorporates a stationary inner cylinder and a moveable outer cylinder. For example, a toy projectile launcher in accordance with the present invention may incorporate a cocking mechanism to prepare the toy projectile launcher from firing using a motion other than the rearward linear motion of the slide member 28. Further, a toy projectile launcher may be configured such that rearward pivotal movement of a mechanism similar to the rearward cocking of a hammer of a revolver may move the outer cylinder rearward to the cocked position. Similarly, a toy projectile launcher may be configured such that circular or other non-linear movement of a trigger may release the cocked outer cylinder to fire the toy projectile launcher.

In further alternative embodiments, a toy projectile launcher may be implemented such that the toy projectile launcher may be cocked and fired in a single motion. For example, the toy projectile launcher may include a mechanism connecting the trigger to the moving outer cylinder such that as the trigger is pulled, the mechanism initially draws the moving outer cylinder rearward and, once the trigger reaches a firing position, the mechanism disengages from the moving outer cylinder to allow the outer cylinder to be thrust forward and fire the toy projectile launcher. Alternatively, the toy projectile launcher may incorporate a reciprocating mechanism, similar to a gattling gun, wherein the moving outer cylinder is pulled rearward and released to fire the toy projectile launcher as the reciprocating mechanism progresses through a cycle of movement. Additionally, those skilled in the art will understand that the toy projectile launcher incorporates a stationary inner cylinder and a sliding outer cylinder may be implemented with configurations other than a pistol as illustrated in the drawings.

FIGS. 4-9 illustrate a toy projectile launcher 10 wherein the firing mechanism includes a hollow inner cylinder 36 slidable within a hollow inner cylinder 38. Other firing mechanism configurations having sliding outer cylinder and a stationary compression member are contemplated as having use in the present invention and will be understood by those skilled in the art. For example, the inner cylinder may be substantially solid with an air passage running therethrough to place the interior of the outer cylinder in fluid communication with a toy projectile. In this embodiment, the inner cylinder may be configured such that a toy projectile may be disposed on the exterior of the muzzle 24, or may include a wider portion of the air passage proximate the muzzle 24 to allow insertion of the dart 24 therein.

Figure 10:
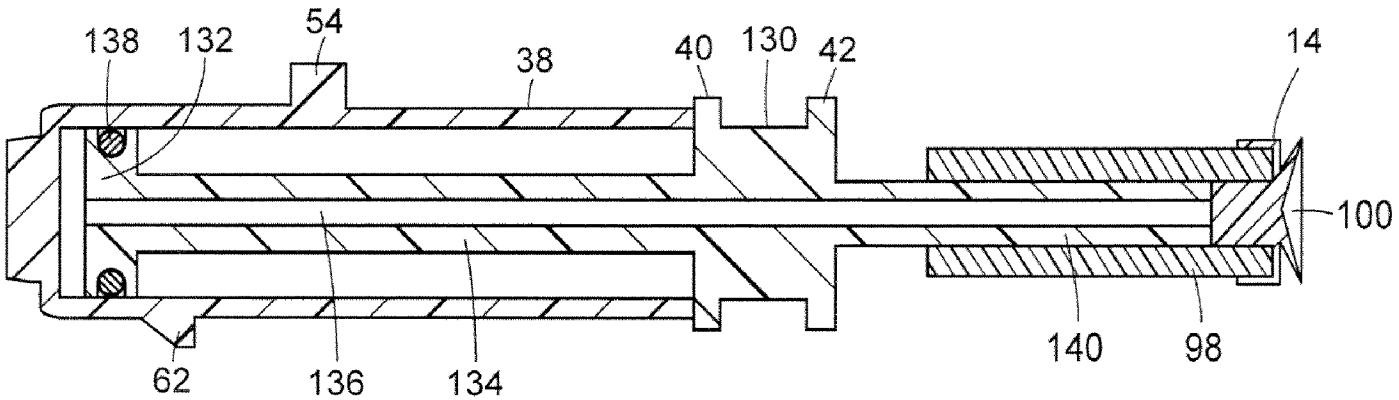
FIG. 10 is a side cross-sectional view of an alternative embodiment of a firing mechanism for the toy projectile launcher of FIG. 1 in the un-cocked position.
Figure 11:
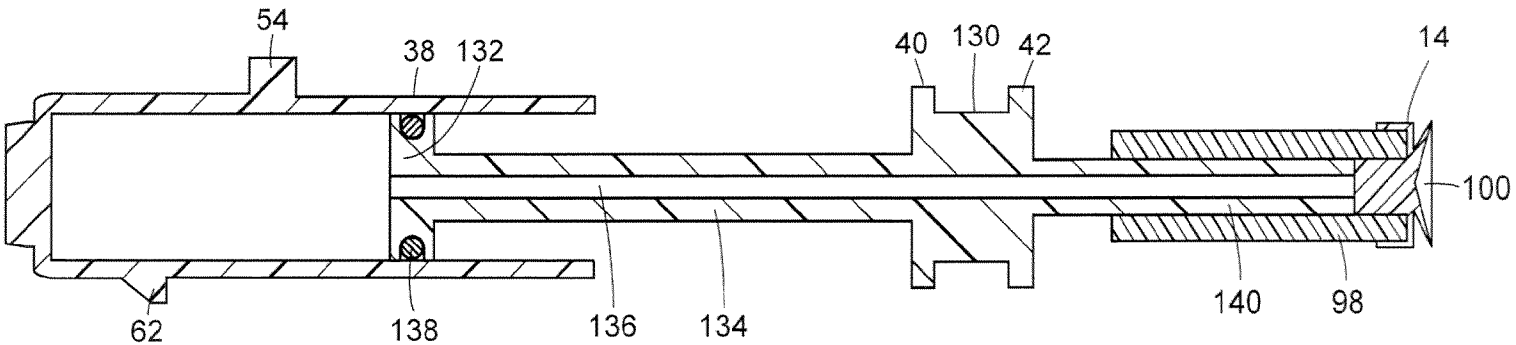
FIG. 11 is a side cross-sectional view of the firing mechanism of FIG. 10 in the cocked position.

A further alternative firing mechanism is illustrated in FIGS. 10 and 11. In the illustrated embodiment, the hollow inner cylinder 34 may be replaced by an alternative compression member in the form of a piston 130. As with the inner cylinder 34, the piston 130 may include outwardly extending flanges 40, 42 that may be engaged by the housing 12 of the toy projectile launcher 10 to hold the piston 130 substantially stationary within the housing 12 with the piston 130 being disposed within the outer cylinder 38 and slidable therein. The piston 130 may include a piston head 132 and stem 134 extending into the outer cylinder when the outer cylinder 38 is in the uncocked position shown in FIG. 10. An inner surface of the piston 130 may define a channel 136 running through the piston head 132 and stem 134 and in fluid communication with the interior of the outer cylinder such that air compressed as the outer cylinder 38 moves forward toward the uncocked position flows through the channel 136. In order to prevent compressed air from flowing around the piston head 132, an O-ring gasket 138 may be disposed about the outer edge of the piston head 132 and engage the inner surface of the outer cylinder 38 and the outer edge of the piston head 132 to form a substantially air-tight seal as the outer cylinder 38 slides about the piston head 132 to cause the compressed air to flow through the channel 136. The piston 130 may further include an outwardly extending nozzle 140 that may project outwardly from the housing 12 and be configured to receive a toy projectile such as dart 14 thereon. The channel 136 may extend through the nozzle 140 to place the interior of the outer cylinder 38 in fluid communication with the exterior of the toy projectile launcher 10 and, consequently with the dart 14. As the outer cylinder 38 is drawn reward to the cocked position illustrated in FIG. 11, the piston 130 may remain stationary within the housing 12. When the locking mechanism is released and the outer cylinder 38 is thrust forwardly by the force of the spring 60, air compressed in the interior of the outer cylinder 38 may flow into the channel 136 of the piston 130 and act on the dart 14 on the nozzle 140 to project the dart outwardly from the toy projectile launcher 10.

Figure 12:
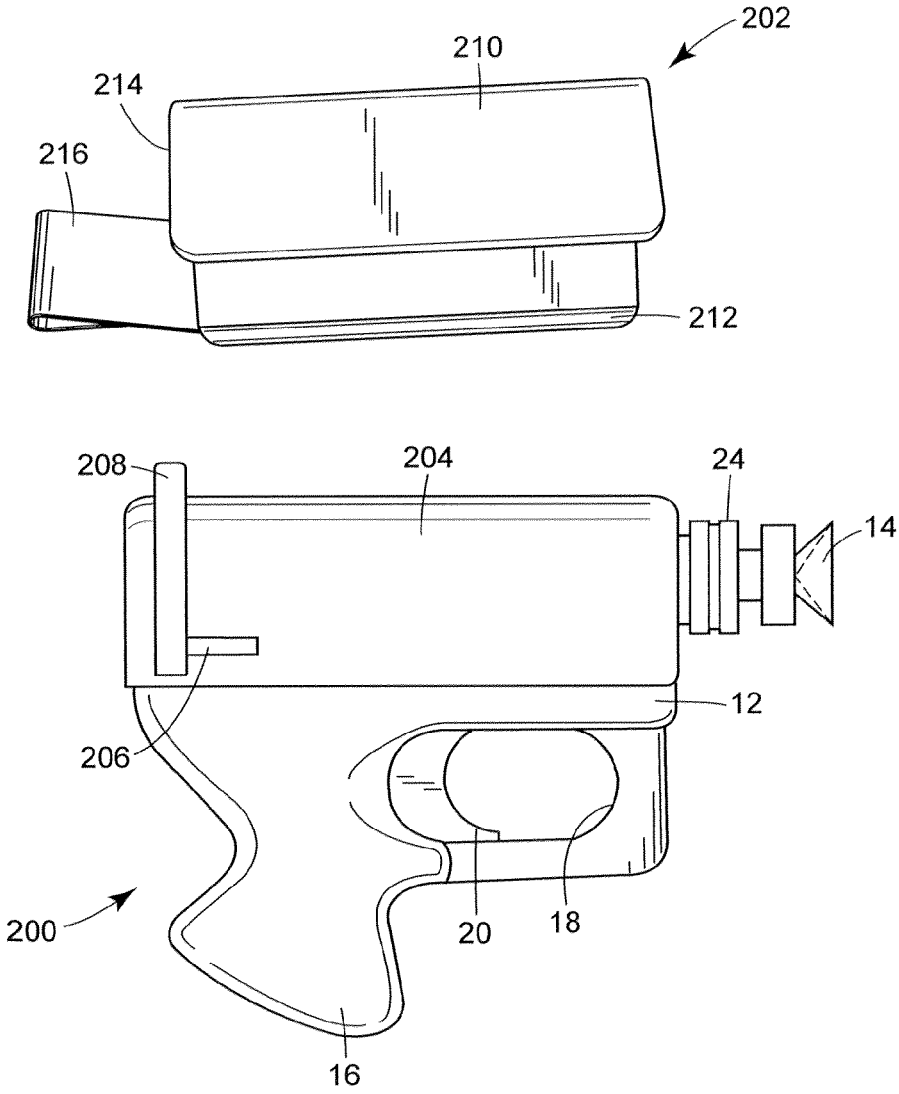
FIG. 12 is a side view of an alternate embodiment of a toy projectile launcher and an accompanying holster.

FIGS. 12-16 illustrate a further alternative embodiment of a toy projectile launcher 200 adapted to be demountably engaged by a holster 202, wherein similar components of the toy projectile launcher 200 as previously discussed are identified by the same reference numerals. Referring to FIG. 12, the toy projectile launcher 200 may include a slide member 204 adapted to be engaged and retained by the holster 202. The slide member 204 may include detents 206 (only one shown) extending outwardly from the sides of the slide member 204, and may further include a shoulder extending outwardly from the sides and top of the slide member 204. The interior mechanisms of the toy projectile launcher may be similar to those illustrated in FIGS. 1-11 and the accompanying text such that the toy projectile launcher 200 may be cocked by sliding the slide member 204 and, consequently, an outer cylinder disposed therein rearward, and the toy projectile launcher 200 may be fired by puling the trigger 20 or otherwise actuating the firing mechanism of the toy projectile launcher 200.

The holster 202 may include an outer retention member 210 having an inverted substantially U-shaped cross-section such that the retention member 210 may enclose the top and sides of the slide member 204 when the retention member 210 is demountably attached to the slide member 204. The retention member 210 may have ridges 212 extending inwardly proximate the lower edges of the retention member 210 or other attachment mechanisms configured to engage the detents 206 of the slide member 204 when the retention member 210 is attached to the slide member 204 to prevent the slide member 204 from being pulled downwardly and out of the open end of the retention member 210. When the slide member 204 is disposed within and retained by the retention member 210, a rear edge 214 of the retention member 210 may be engaged by the shoulder 208 to prevent the slide member 204 from moving forwardly within the retention member 210 while allowing the slide member 204 to slide rearwardly within the retention member 210 to be removed from the holster 202. The holster 202 may further include an attachment mechanism, such a strap 216, a clip, or the like, extending from the retention member 210 and adapted to attach to an article of clothing, such as a belt, belt loop, pants and the like, of a user of the toy projectile launcher. The attachment mechanism may be a separate component connected to the retention member 210, or may be integrally formed with and extend from the retention member 210.

Figure 13:
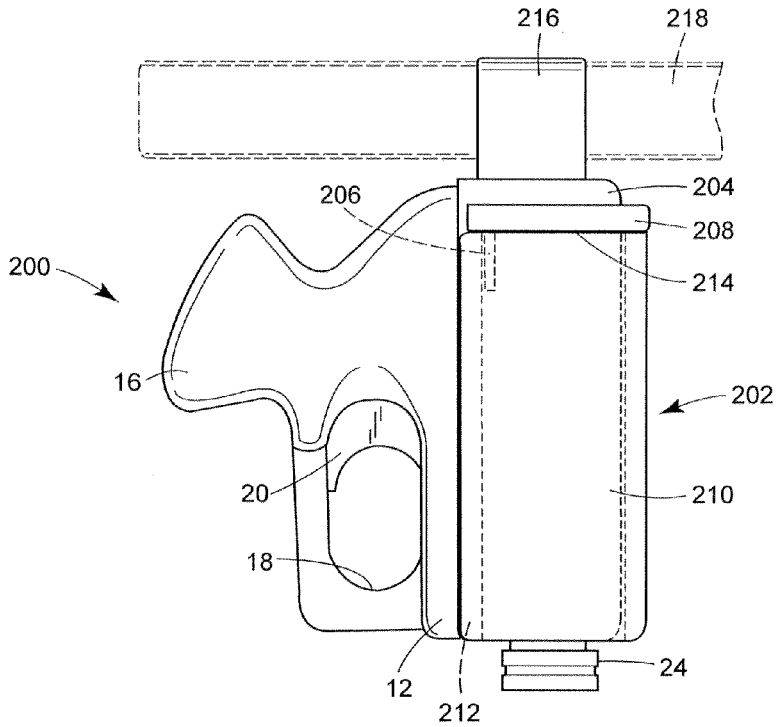
FIG. 13 is a side view of the toy projectile launcher of FIG. 12 disposed in the holster and attached to a user's belt.

Referring to FIG. 13, the holster 202 is illustrated being worn by a user and hanging at the user's side, with the strap 216 having the user's belt 218 threaded therethrough. FIG. 13 further illustrates the toy projectile launcher 200 attached to the holster 202 with the slide member 204 being disposed within the retention member 210. As illustrated, the detents 206 may be engaged by the inwardly extending ridges 212 of the retention member 210 to prevent the toy projectile launcher 200 from being removed from the holster 202 by pulling the toy projectile launcher 200 to the left as shown in FIG. 13. Further, the shoulder 208 may engage the rear edge 214 of the retention member 210 to prevent the slide member 204 from moving downwardly and out of the retention member 210.

Figure 14:
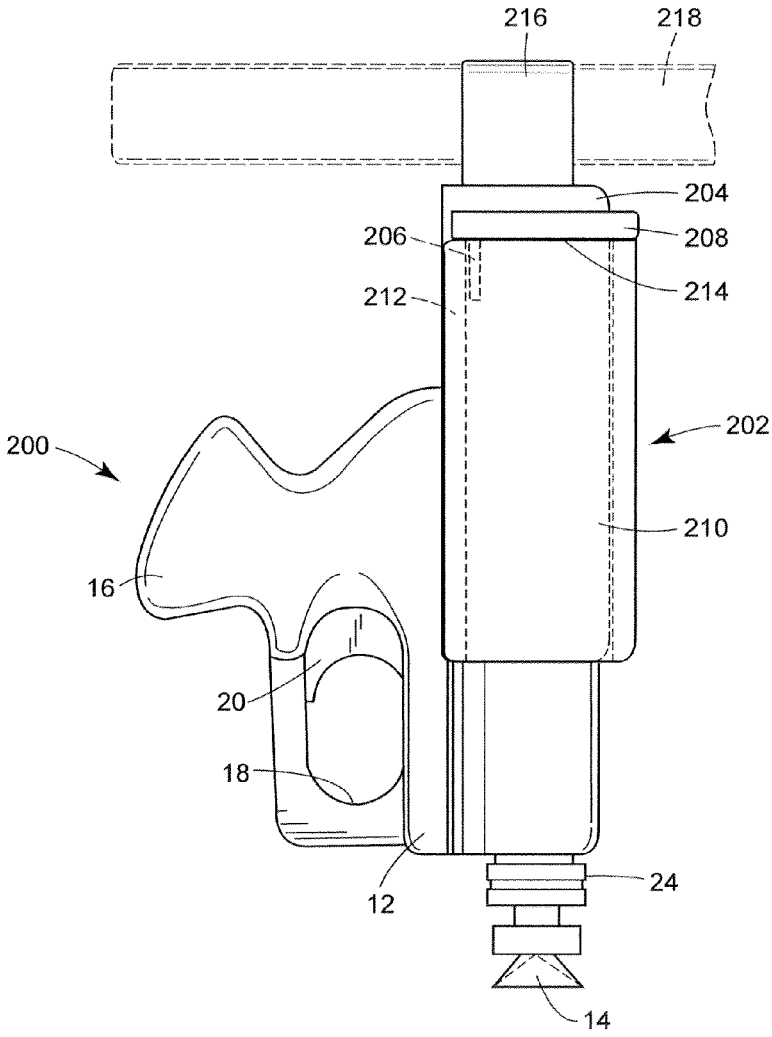
FIG. 14 is a side view of the toy projectile launcher of FIG. 12 disposed in the holster and in a cocking position.
Figure 15:
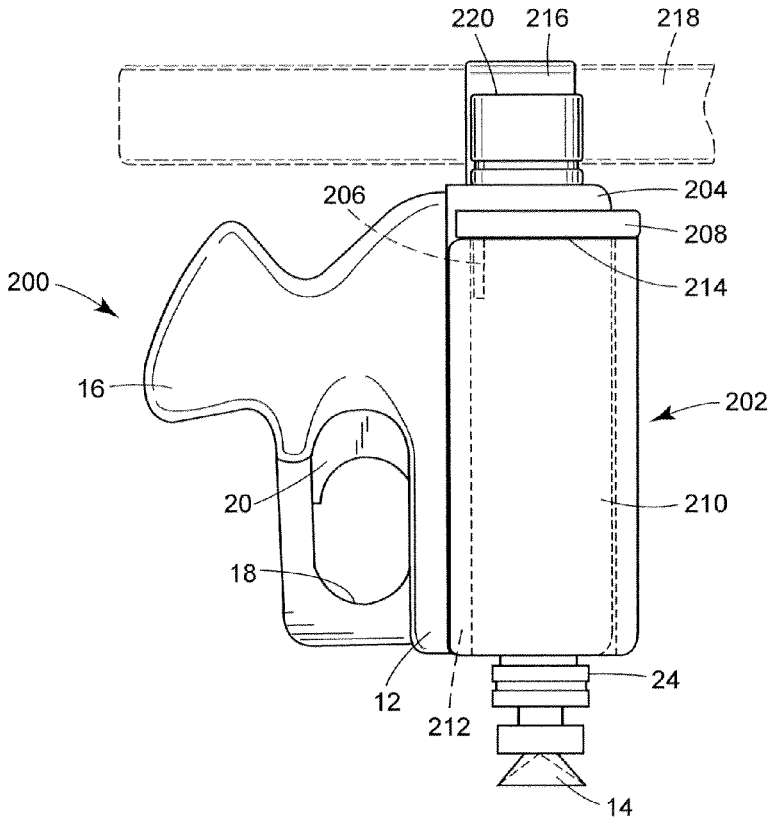
FIG. 15 is a side view of the toy projectile launcher of FIG. 12 disposed in the holster and in a cocked position.
Figure 16:
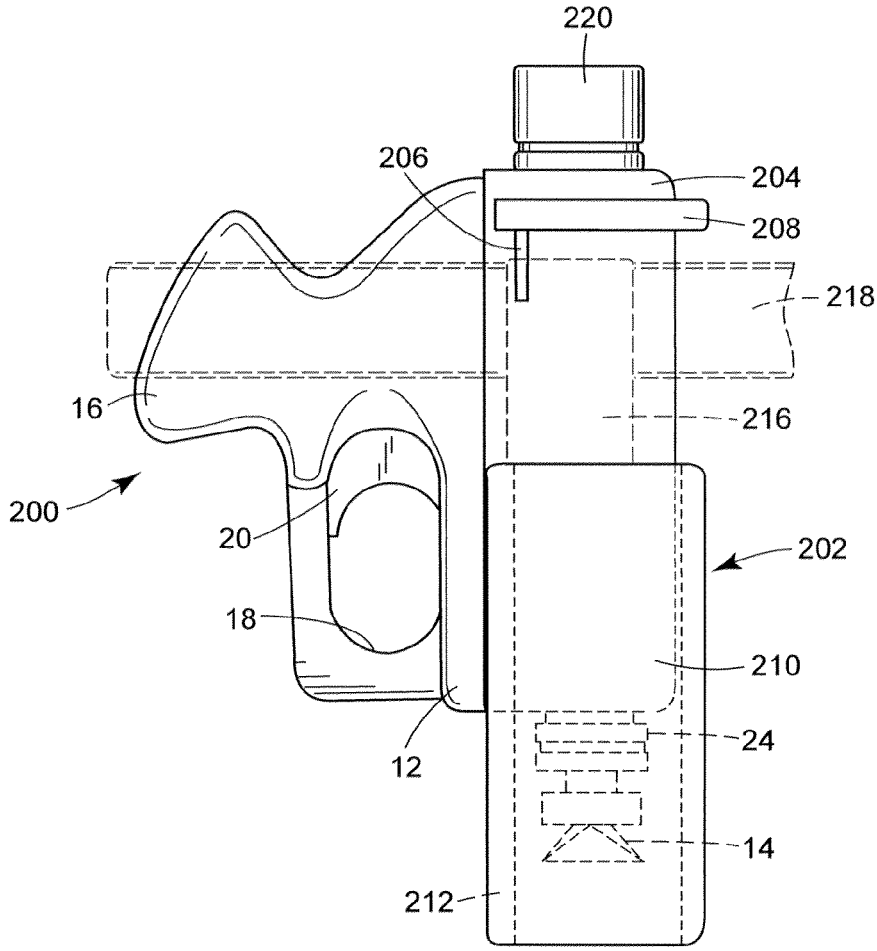
FIG. 16 is a side view of the toy projectile launcher of FIG. 12 being removed from the holster.

FIG. 14 illustrates the toy projectile launcher 200 being cocked while disposed within the holster 202. The user may grasp the toy projectile launcher 200 by the grip 16 and push downwardly to move the housing 12 relative to the slide member 204 against the urging of the springs biasing the slide member 204 and outer cylinder forward. As the housing 12 moves forward, the internal locking mechanism may engage the outer cylinder to cock the toy projectile launcher 200. As discussed above, the engagement of the shoulder 214 by the rear edge 214 of the retention member 210 prevents the slide member 204 from sliding downward within the retention member 210. Once the toy projectile launcher 200 is cocked and released by the user, the housing 12 returns to its normal position under the force of the spring biasing the slide member 204 toward the normal position as shown in FIG. 15. In this embodiment, the components may be dimensioned such that the outer cylinder 220 of the toy projectile launcher 200 may extend rearwardly out of an opening in the housing 12 when the toy projectile launcher 200 is cocked. Once the toy projectile launcher 200 is cocked, the toy projectile launcher 200 may be removed from the holster 202 by pulling the toy projectile launcher 200 upwardly as shown in FIG. 16, with the slide member 202 sliding out of the retention member 210. When the detents 206 disengage from the ridges 212 of the retention member 210, the toy projectile launcher 200 may also move to the left as shown in FIG. 16 and outward from the retention member 210.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

The invention claimed is:

1. A toy projectile launcher for discharging a toy projectile comprising:

a housing;

an air compression mechanism disposed on the housing and comprising a compression member disposed on the housing and a hollow outer cylinder having the compression member slidably disposed therein, wherein the outer cylinder is moveable relative the housing between an uncocked position and a cocked position such that movement of the outer cylinder from the cocked position to the uncocked position compresses air in the interior of the outer cylinder to discharge the toy projectile;

a slide member slidably disposed on the housing and operatively connected to the air compression mechanism such that movement of the slide member from a first position to a second position causes the outer cylinder to move from the uncocked position to the cocked position;

a retention member configured to demountably attach to the slide member, wherein the slide member may move from the first position to the second position when the retention member is demountably attached thereto; and an attachment mechanism connected to the retention member and configured to engage an article of clothing of a user of the toy projectile launcher.

2. A toy projectile launcher for discharging a toy projectile comprising:

a housing;

an air compression mechanism disposed on the housing comprising:

a hollow outer cylinder, a compression member disposed on the housing, and slidably received within the hollow outer cylinder, the compression member having a fluid passage therethrough in fluid communication with the interior of the outer cylinder, wherein the outer cylinder is moveable between an uncocked position and a cocked position such that movement of the outer cylinder from the cocked position toward the uncocked position compresses air in the interior of the outer cylinder, with the compressed air being delivered through the fluid passage to a toy projectile assembled with the toy projectile launcher, and a spring biasing the outer cylinder from the cocked position toward the uncocked position, a slide member slidably disposed on the housing and operatively connected to the air compression mechanism, wherein the slide member is operatively coupled to the hollow outer cylinder, and wherein movement of the slide member from a first position to a second position causes the outer cylinder to move from the uncocked position to the cocked position;

a retention member configured to demountably attach to the slide member, wherein the slide member may move from the first position to the second position when the retention member is demountably attached thereto; and an attachment mechanism connected to the retention member and configured to engage an article of clothing of a user of the toy projectile launcher.

3. A toy projectile launcher in accordance with claim 1, comprising a slide spring biasing the slide member toward the first position.

4. A toy projectile launcher for discharging a toy projectile comprising:

a housing;

an air compression mechanism disposed on the housing and comprising a compression member disposed on the housing and a hollow outer cylinder having the compression member slidably disposed therein, wherein the outer cylinder is moveable relative the housing between an uncocked position and a cocked position such that movement of the outer cylinder from the cocked position to the uncocked position compresses air in the interior of the outer cylinder to discharge the toy projectile;

a slide member slidably disposed on the housing and operatively connected to the air compression mechanism such that movement of the slide member from a first position to a second position causes outer cylinder to move from the uncocked position to the cocked position;

a retention member configured to demountably attach to the slide member, wherein the slide member may move from the first position to the second position when the retention member is demountably attached thereto, wherein the retention member engages the slide member to prevent the slide member from being detached from the retention member by movement in a direction perpendicular to the direction of movement of the slide member from the first position to the second position when the retention member is demountably attached to the slide member; and an attachment mechanism connected to the retention member and configured to engage an article of clothing of a user of the toy projectile launcher.

5. A toy projectile launcher in accordance with claim 1, wherein the retention member engages the slide member to prevent the slide member from moving relative to the retention member in a first direction parallel to the direction of movement of the slide member from the first position to the second position, and to permit the slide member to move relative to the retention member in the opposition direction.

6. A toy projectile launcher in accordance with claim 1, wherein the retention member and the attachment mechanism are integrally formed from a single piece of material.

* * * * *